US008850720B2

(12) United States Patent
Marechal

(10) Patent No.: US 8,850,720 B2
(45) Date of Patent: Oct. 7, 2014

(54) SPORTS BOOT

(75) Inventor: Pierre Alexis Marechal, Annecy (FR)

(73) Assignee: Salomon S.A.S., Metz Tessy (FR)

( * ) Notice: Subject to any disclaimer, the term of this patent is extended or adjusted under 35 U.S.C. 154(b) by 1039 days.

(21) Appl. No.: 11/961,059

(22) Filed: Dec. 20, 2007

(65) Prior Publication Data

US 2008/0148602 A1 Jun. 26, 2008

(30) Foreign Application Priority Data

Dec. 21, 2006 (FR) ..... 06 11300

(51) Int. Cl.
*A43C 11/00* (2006.01)
*A43B 5/04* (2006.01)

(52) U.S. Cl.
CPC ..... *A43B 5/0433* (2013.01)
USPC ..... 36/50.1; 36/50.5; 36/118.2; 36/117.7; 36/115

(58) Field of Classification Search
USPC ..... 36/117.1, 117.2, 117.6–117.8, 36/118.2–118.4, 118.7–118.9, 119.1, 50.1, 36/50.5
See application file for complete search history.

(56) References Cited

U.S. PATENT DOCUMENTS 3,721,023 A * 3/1973 Kastinger ..... 36/118.2
4,179,827 A * 12/1979 Vaccari ..... 36/117.8
4,601,118 A * 7/1986 Zanatta ..... 36/118.7
4,611,415 A * 9/1986 Tonel ..... 36/115
4,615,127 A * 10/1986 Delery ..... 36/117.8
4,660,302 A * 4/1987 Arieh et al. ..... 36/118.9
4,719,709 A * 1/1988 Vaccari ..... 36/117.8
4,888,889 A * 12/1989 Sartor ..... 36/118.7
4,907,353 A * 3/1990 Wittmann et al. ..... 36/117.2
4,916,836 A * 4/1990 Baggio et al. ..... 36/117.7
5,012,598 A * 5/1991 Baggio et al. ..... 36/117.8
5,020,248 A * 6/1991 Hercog et al. ..... 36/117.8

(Continued)

FOREIGN PATENT DOCUMENTS

EP 169831 A1 * 1/1986 ..... A43B 5/04
EP 0 317 764 A2 5/1989

(Continued)

*Primary Examiner* — Khoa Huynh
*Assistant Examiner* — Timothy K Trieu
(74) *Attorney, Agent, or Firm* — Greenblum & Bernstein, P.L.C.

(57) ABSTRACT

A sports boot including an upper extending above the ankle joint and at least one rigid collar extending around the wearer's lower leg, the boot including a device for adjusting the volume of the collar to better accommodate the shape of the user's calf. The adjustment device includes a wedge, or collar extension, positioned inside the collar, the wedge being fixed to the collar by means of at least one pivot and by means of a fastening mechanism enabling the relative displacement of the wedge with respect to the collar as well as a deformation of the wedge. The fastening mechanism includes a plate equipped with a cylindrical body having an axis A1 and received in a first circular opening provided in the collar and a rivet received in a second circular opening provided in the wedge and received in a third circular opening having an axis A2 provided in the body, the axis A2 and the axis A1 being non-coaxial. The wedge is fixed by means of a first pivot and a second pivot, which are positioned on respective sides of the collar so that an axis Ap1 of the first pivot and an axis Ap2 of the second pivot are located on a first, substantially horizontal plane P1 and so that the fastening mechanism is not fixed on the first plane P1.

26 Claims, 4 Drawing Sheets

(56) References Cited

U.S. PATENT DOCUMENTS

| | | | | | |
|---|---|---|---|---|---|
| 5,031,341 | A | * | 7/1991 | Paris et al. | 36/118.8 |
| 5,054,215 | A | * | 10/1991 | Tonel et al. | 36/118.8 |
| 5,109,615 | A | | 5/1992 | Sartor | |
| 5,259,127 | A | * | 11/1993 | Pallatin | 36/118.7 |
| 5,394,628 | A | * | 3/1995 | DeMarchi | 36/118.9 |
| 5,437,466 | A | * | 8/1995 | Meibock et al. | 280/11.202 |
| 5,461,802 | A | * | 10/1995 | Paris et al. | 36/118.7 |
| 5,483,758 | A | * | 1/1996 | Gorza et al. | 36/117.7 |
| 5,508,899 | A | * | 4/1996 | McCormick | 362/103 |
| 5,553,402 | A | * | 9/1996 | Marega et al. | 36/117.7 |
| 5,632,105 | A | * | 5/1997 | Bonaventure | 36/117.1 |
| 5,778,566 | A | * | 7/1998 | Edauw et al. | 36/117.1 |
| 5,826,355 | A | * | 10/1998 | Vaccari | 36/118.1 |
| 5,860,227 | A | * | 1/1999 | Perrissoud | 36/118.3 |
| 5,967,531 | A | * | 10/1999 | Saillet | 280/11.36 |
| 6,336,279 | B1 | * | 1/2002 | Orso | 36/117.1 |
| 6,993,859 | B2 | * | 2/2006 | Martin et al. | 36/50.5 |
| 2005/0016027 | A1 | * | 1/2005 | Trinkaus et al. | 36/115 |
| 2005/0081408 | A1 | * | 4/2005 | Chaigne et al. | 36/117.6 |
| 2005/0102860 | A1 | | 5/2005 | Sartor et al. | |

FOREIGN PATENT DOCUMENTS

| | | | |
|---|---|---|---|
| EP | 0 371 915 | A1 | 6/1990 |
| EP | 0 724 850 | A1 | 8/1996 |
| FR | 2 357 197 | A1 | 2/1978 |
| WO | WO-03/077695 | A1 | 9/2003 |

* cited by examiner

SPORTS BOOT

CROSS-REFERENCE TO RELATED APPLICATION

This application claims priority under 35 U.S.C. §119 of French Patent Application No. 06 11300, filed on Dec. 21, 2006, the disclosure of which is hereby incorporated by reference thereto in its entirety.

BACKGROUND OF THE INVENTION

1. Field of the Invention

The invention relates to a sports boot having an upper including tightening devices so as to secure the boot on the lower portion of the user's leg, and further relates to a device for adjusting a portion of the contour of the boot to the shape of the portion of the lower leg portion the device faces, independently of the tightening devices.

2. Description of Background and Other Information

Adjustment devices of the above-mentioned type that are known in the field of ski boots, for example, are generally located on the side of the upper that is opposite the tightening devices. They improve the adaptation of the upper portion of the upper of the boot to the shape of the skier's leg and, for example, they adjust the advance angle. As the most substantial variations in the shape of the leg are in the areas of muscle mass, especially in the calves, the adjusting devices are most often implemented in the rear portion of the upper. The patent document FR 2 357 197, for example, discloses an adjusting device positioned in the rear portion of the boot upper.

This device has an upwardly open vertical recess and is made in the rear portion of the upper. A blocking device provided with a tensioning element acting on a transverse tongue or on a cable maintains the edges of the recess at a given distance that depends upon the active length of the tongue or cable. Therefore, in order to adapt to a big calf or to reduce the advance angle, the active length of the tongue or cable of the blocking device is increased. The recess edges can then move apart from one another to let the calf through or to enable the leg to somewhat straighten up, which means a diminution of the advance angle. In the latter case, the tightening devices of the upper are then tightened so that the upper always keeps the same perimeter for enveloping the lower portion of the user's leg. Conversely, to adapt the upper to a small calf or to increase the advance angle, the active length of the tongue or of the cable is reduced to cause the edges of the recess to move closer to one another and come into contact with the calf or to push the latter forward, which accentuates the advance angle. In this case, the devices for tightening the upper are loosened so that the upper always maintains the same perimeter for enveloping the lower part of the leg. This adjusting device can be functional only for use with sports boots that have a relatively flexible upper. In addition, this device is provided to be loosened after each use and requires, with each use, that the user again find, or remember, the adjustment that suits him or her.

Still by way of example, the patent document EP 371 915 discloses an adjustment device of the same type as described above, but is provided, in this case, with an articulated flap at the lower portion of the vertical recess, which it closes. In this adjustment device, the flap acts on the edges of the recess and determines the modification of the perimeter for enveloping the upper around the bottom of the leg by means of adjustable connecting elements located on the wings of the flap. Unlike the previous adjustment device, this device blocks the edges of the recess equally in the direction for moving them as well as in the direction for spacing them apart, thereby ensuring a firm support for the lower part of the user's leg, even if the direction of forces is offset with respect to the recess. However, by using a flap that is essentially articulated at the lower portion of the recess, the support surface or zone that the flap provides for the lower leg portion varies depending upon its angle of inclination. Indeed, when the flap is tilted rearward to increase the enveloping perimeter of the upper, the support surface provided is substantially equal to the total surface of the flap, which allows the spreading of forces over a large surface. However, the more the flap is forwardly inclined to reduce the enveloping area of the upper, the smaller the support surface becomes toward the upper edge of the flap. In this case, the forces of the lower leg are distributed only over a small surface, which causes painful pressure points for the user in the zone of contact with the flap. In addition, such a device requires the user to manipulate numerous small-size independent pieces, such as rods and screws, which can be challenging in a winter sports environment where one often wears gloves.

SUMMARY OF THE INVENTION

The invention provides a sports boot including a collar, or cuff, positioned above the ankle joint and including a device for adjusting the volume of the collar to the shape of the user's calf. The adjustment device allows for limitations of known prior art devices to be overcome. In particular, the invention provides a device, different from the existing solutions, for adjusting the volume of the collar to the calf and which can be used with hard-shell boots.

In addition, the present invention provides a sports boot including a collar and a device for adjusting the volume of the collar to the shape of the calf that allows for a memorized adjustment.

Still further, the present invention provides a sports boot including a collar and a device for adjusting the volume of the collar to the shape of the calf that provides enhanced comfort and a better distribution of the forces exerted by the rear portion of the boot on the lower portion of the user's leg.

Still further, the invention provides a sports boot including a collar and a device for adjusting the volume of the collar to the shape of the calf and which renders it easier for the user to manipulate.

The present invention further provides a sports boot, including a comfort liner, a collar, and a device for adjusting the volume of the collar to the shape of the calf that also provides for a better adaptation of the volume of the comfort liner to the shape of the user's calf.

More particularly, the invention includes a sports boot that includes an upper extending above the ankle joint and at least a rigid collar surrounding the lower portion of a user's leg, the boot including a device for adjusting the volume of the collar to the shape of the user's calf, the adjustment device including a wedge placed inside the collar and fixed to the collar by means of at least one pivot and by a fastening mechanism allowing the relative displacement of the wedge with respect to the collar, as well as for deforming the wedge.

Advantageously, the wedge's deformation enables it to better adapt to the shape of the user's calf while ensuring an even distribution of the forces exerted thereon by the boot.

In a particular embodiment, the fastening mechanism is made of a plate equipped with a cylindrical body having an axis A1, which is received in a first circular opening provided in the collar, and a rivet that is received in a second circular opening provided in the wedge and which is received in a third circular opening having an axis A2 provided in the body, the axes A2 and A1 being non-coaxial.

In an embodiment of the invention, the wedge is fixed by means of a first pivot and a second pivot, which are positioned on the sides of the collar so that the axis of the first pivot and the axis of the second pivot are located on a substantially horizontal first plane P1, and the fastening mechanism is not fixed on the first plane P1.

In a particular embodiment, the wedge includes at least one notch allowing the wedge to deform.

In an embodiment of the invention, the boot includes a comfort liner which includes a rear opening and a rear tongue. The rear tongue is fixed to the liner at its base and can freely tilt in a front-to-rear movement with respect to this base. As the rear tongue is located under the wedge, it can accompany it in its movement to further improve the adaptation of the fitting volume of the boot to the particular morphology of the user.

BRIEF DESCRIPTION OF DRAWINGS

The invention will be better understood from the description that follows, with reference to the annexed drawings, and in which.

DETAILED DESCRIPTION OF THE INVENTION

Figure 1:
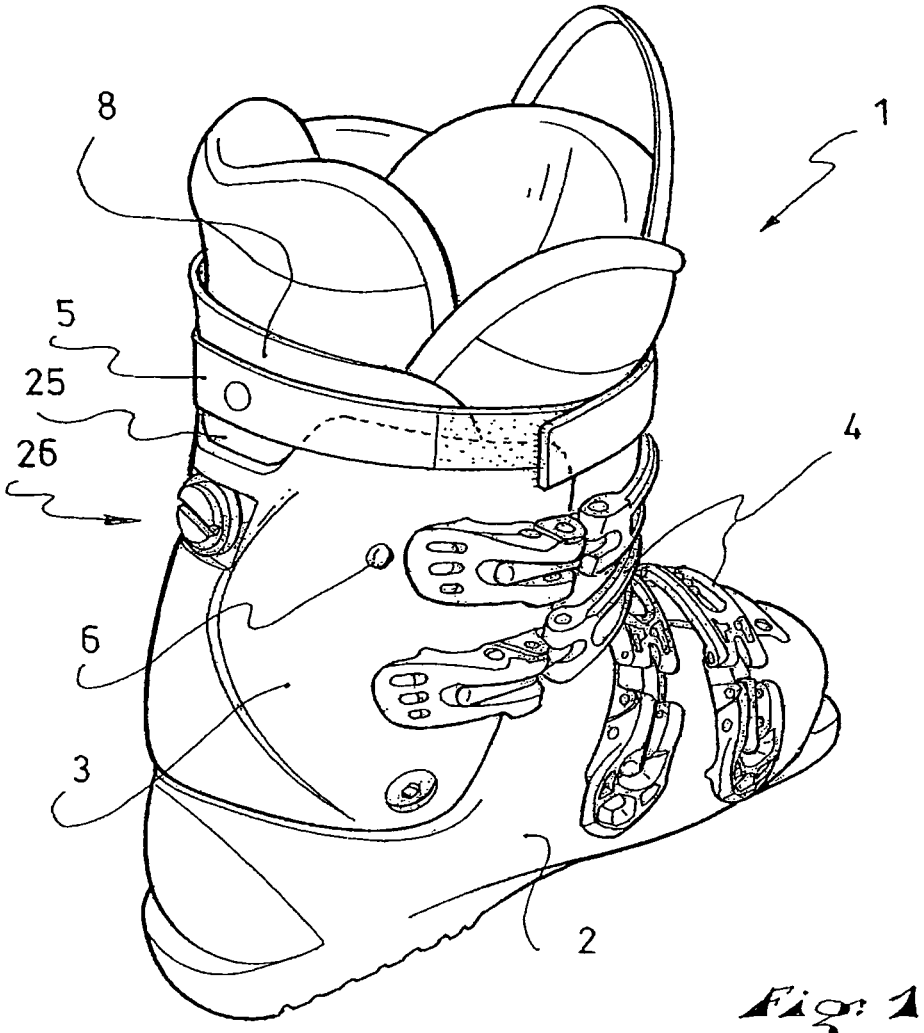
FIG. 1 is a perspective view of an embodiment of the invention.

FIG. 1 shows a ski boot 1 in rear perspective view. The boot includes an upwardly extending outer upper, inside of which a comfort liner 20 is positioned. The upper includes a shell 2, that is, the lower part of the boot 1, topped by a collar or cuff 3.

To provide for the closing of the lower shell portion 2 of the boot, two buckles 4 are positioned thereon. To provide for the closing of the collar 3, two buckles 4 are also positioned on the sides of the collar 3, to which is added a flexible lower leg strap 5, positioned at the top of the upper. The buckles shown are of a type known to those skilled in the art and, therefore, they are not described in further detail herein.

The adjustment device 26 is shown on the upper portion of the collar 3. It includes a wedge 8 fixed inside the collar and a fastening mechanism 11 fixed at the rear of the collar 3. The adjustment device 26 also includes two pivots that connect the wedge to the collar on the upper portion, above the ankle, and are on the sides of the collar, only the first pivot 6 of which is shown in the drawing. Each of the pivots can take the form of a rivet, a screw-nut combination, or other structural arrangement to facilitate articulation of the wedge 8 with respect to the collar 3.

Although the element 8 is referred herein as a "wedge," the term is not intended to indicate that the element itself necessarily has a shape that includes a pair of primary surfaces tapering toward each other at a sharply acute angle, but that it is positioned between the collar 3 and the wearer's lower leg.

Figure 2:
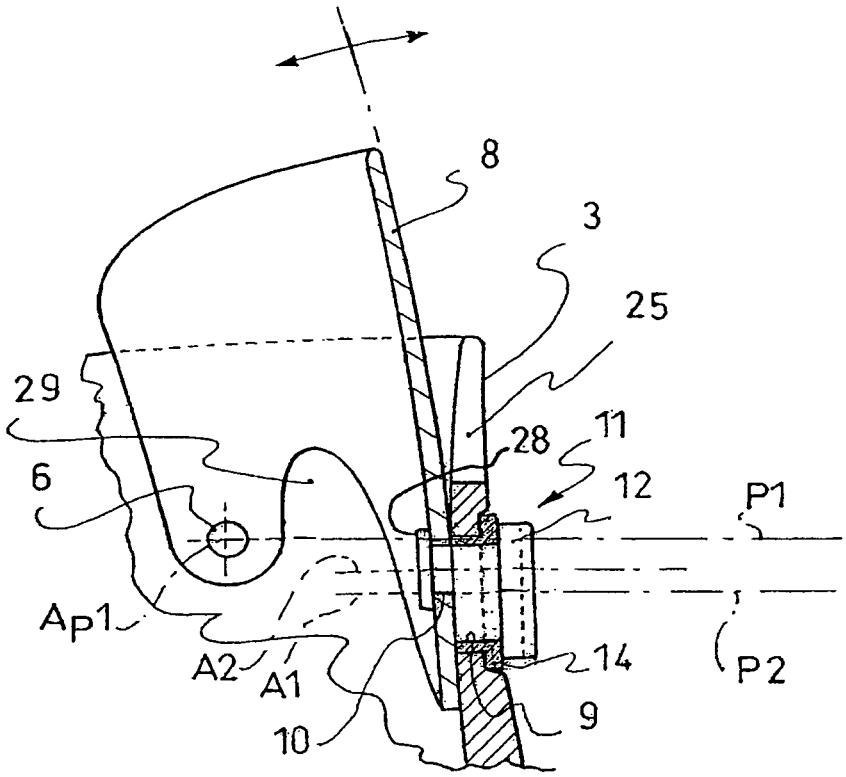
FIG. 2 is a partial cross-section of the collar of the boot shown in FIG. 1, positioned for accommodating a lower leg having a small volume.

FIG. 2 shows a partial cross section of the upper portion of the collar. This cross section is taken along a vertical longitudinal plane of the boot and shows the upper portion of the collar 3 as well as the wedge 8 of the device 26 for adjusting the volume of the collar.

The wedge 8 has substantially the shape of a tile, that is, a cylindrical portion or a substantially cylindrical portion. Its shape follows the shape of the inside of the rear portion of the collar 3, in which it is received. The upper portion of the wedge 8 extends upwardly beyond the upper portion of the collar 3 and, for this reason, can be regarded as an adjustable collar extension, i.e., such as providing adjustment between the orientations shown in FIGS. 2 and 3. Two downwardly open notches 29 provided in the lower portion of the wedge 8 to enable the wedge to deform more easily, as will be seen hereinafter.

The collar 3 includes a recess 25 at the top of its rear portion. This recess enables a certain deformation of the recess.

Figure 3:
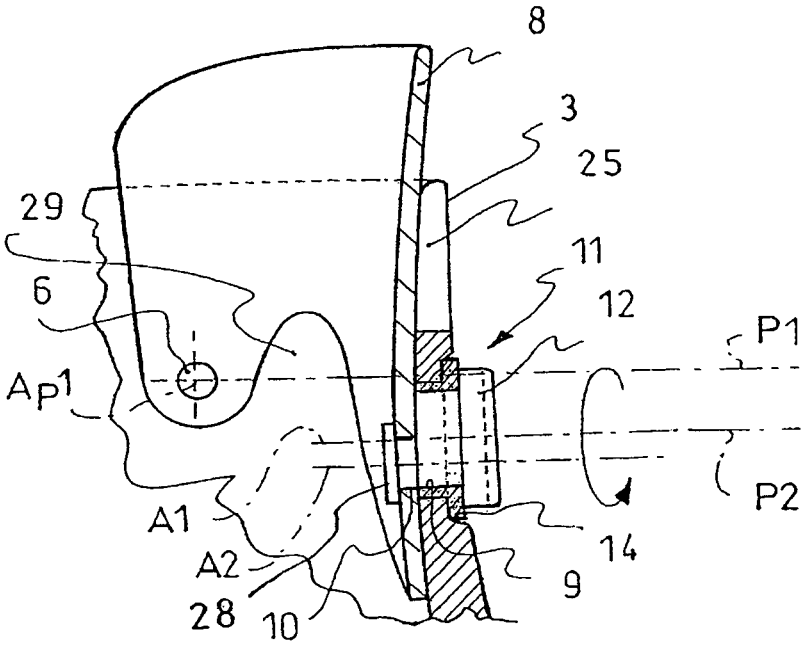
FIG. 3 is a partial cross-section of the collar of the boot shown in FIG. 1, in the case of a large volume.

The wedge 8 includes three fastening points with respect to the collar 3. First, it is fixed in the area of two pivots, namely, the first pivot 6 and the second pivot (on a side of the collar and wedge opposite to that of the first pivot) which are laterally positioned on the collar 3. In FIGS. 2 and 3, only the first pivot 6 is shown. The third point for fastening the wedge 8 to the collar 3 is made by means of a fastening mechanism 11, spaced from the first and second pivots along the collar. As described further below the fastening mechanism 11 is structured and arranged to enable a relative displacement of the wedge with respect to the collar.

The axes of the first and second pivots (axis Ap1 of the first pivot 6 being shown in FIGS. 2 and 3) are located in the same plane P1, which is substantially horizontal. In addition, the axis Ap1 of the first pivot and the axis of the second pivot are substantially coaxial. Because of the generally ovoid shape of a horizontal cross section of the collar, the axes of the first and second pivots are never exactly coaxial. However, they allow for the wedge 8 to be articulated with respect to the collar 3 along an axis passing through the first and second pivots. This axis is substantially perpendicular to the longitudinal vertical plane of the boot.

Figure 4:
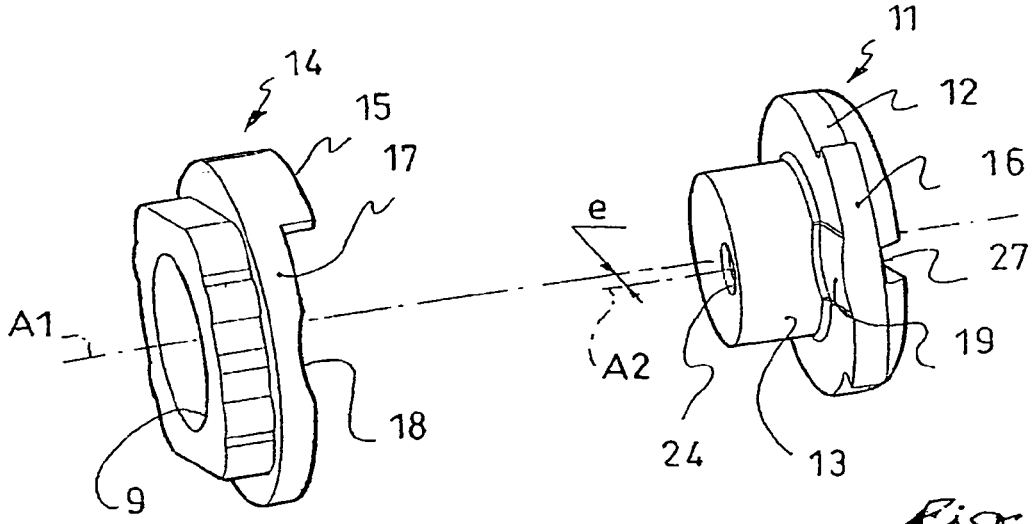
FIG. 4 is a front perspective view of the fastening mechanism.
Figure 5:
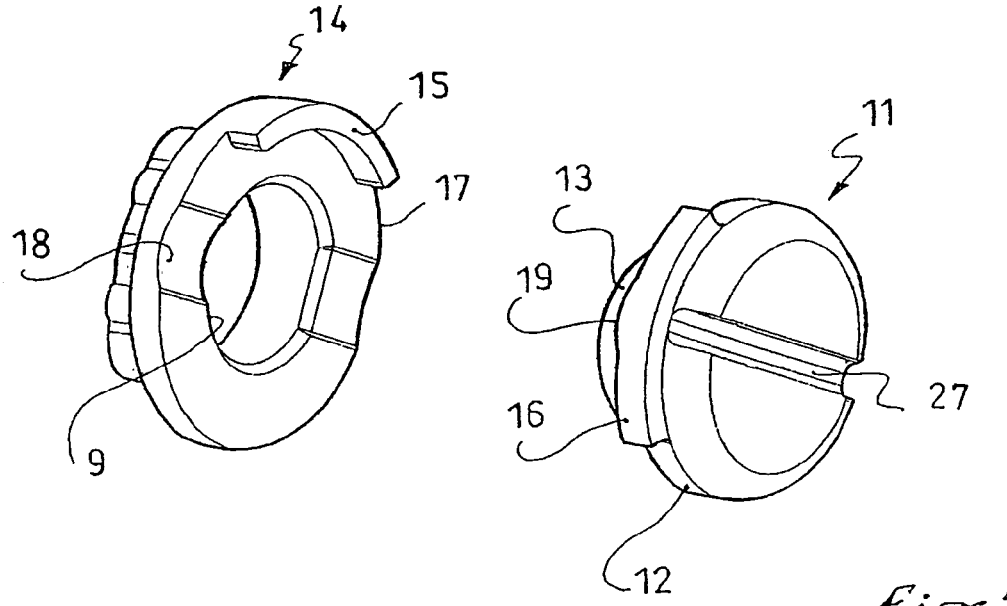
FIG. 5 is a rear perspective view of the fastening mechanism.

FIGS. 4 and 5 show in detail the fastening mechanism 11 as well as the washer 14, or bushing, in which the body 13 of the fastening mechanism is received for rotation, as described below. The fastening mechanism 11 is positioned in the rear portion of the collar 3 and allows and generates the relative movement of the wedge 8 with respect to the collar 3. The relative movement, as just seen, is a rotational movement of the wedge about the first and second pivots.

The washer 14 includes anchoring elements so that it can be fixed in the collar 3. Once positioned, the washer 14 is affixed to the collar 3. The washer 14 also includes a rim 17 in which are provided two diametrically opposed depressions or indentations 18, as well as an abutment 15 on one of its sides. The washer 14 is provided with a first circular opening 9 having an axis A1.

The fastening mechanism 11 includes a plate 12, or head, as well as the body 13. The plate 12 as well as the body 13 are substantially cylindrical elements whose axis is the same as that of the washer, that is, the axis A1. On its outer portion, accessible outside of the boot, the plate 12 includes a groove 27 adapted to receive a tool or any other implement used as a tool, such as the edge of a coin, for manipulation, i.e., rotation, of the plate 12 and, thereby, the fastening mechanism 11, about the axis A1. On its inner portion, that is, the portion which will be in contact with the rim 17 of the washer 14, the plate 12 has two bosses 19 diametrically arranged with respect to one another and with a shape that complements the shape of the recesses 18 provided in the rim 17 of the washer 14.

The plate 12 is also equipped with a sector 16 which projects therefrom and is adapted to cooperate with the abutment 15 of the washer 14. The abutment 15 and the sector 16 define two end positions in the rotational movement of the fastening mechanism 11 with respect to the washer 14. These two positions are diametrically opposed.

In each of these end positions, the bosses 19 of the plate 12 nest within the indentations 18 of the washer. Thereby, these positions define stable positions of the rotational movement of the fastening mechanism with respect to the washer.

The body 13 of the fastening mechanism 11 includes a third opening 24 or through hole. This third opening 24 is off-centered with respect to the axis A1 of the body 13. The third opening 24 is centered about an axis A2 that is parallel to the axis A1 but spaced apart from the latter by a distance "e".

The fastening mechanism 11 also includes a fastener, in the form of a rivet 28, shown in FIG. 2. The rivet 28 extends through a second circular-shaped opening 10 provided in the wedge 8 and is received in the third opening 24 of the body. Thus, the fastening mechanism 11 is fastened to, i.e., engages, a surface of the wedge 8 inside the collar 3, i.e., a surface of the opening 10 of the wedge and an inner surface of the wedge engaged by the head of the rivet 28, as shown, e.g., in FIGS. 2 and 3.

The fastening mechanism 11 functions as an eccentric button connecting the rear portion of the wedge 8 with the rear portion of the collar 3. The distance "e" separating the axis A1 from the axis A2 determines the amplitude of the relative movement of the wedge with respect to the collar.

When the fastening mechanism 11 is positioned in the washer 14, the washer being affixed to the collar 3, the axis A1 is not in the plane P1 of the pivots of the collar (pivot 6, e.g.), but rather below the plane P1.

FIGS. 2 and 3 show the adjustment device 26 in the "small volume" position and in the "large volume" position, respectively, each defining a different use position of the boot and a different volume for the wearer's lower leg. In FIG. 2, the plate 12 is turned so that the axis A2 of the third opening, which also happens to be the axis of the rivet 28, is located above the axis A1. Between the fastening mechanism 11 and the first pivot 6, the wedge 8 is provided with a notch 29 which enables it to be deformable. Although it is not shown in this cross-sectional view, a similar notch is provided between the fastening mechanism and the second pivot.

In FIG. 3, the plate 12 is turned so that the axis A2 of the rivet 28 is positioned below the axis A1 of the plate. The wedge 8 is then in the "large volume" configuration. Between the "small volume" position and the "large volume" position, the third point for fastening the wedge 8 to the collar 3 has been displaced downwardly by a distance equal to twice the eccentricity of the eccentric button, that is, by a value "2×e". This displacement of the third fastening point generates deformation of the wedge, enabled by the presence of the notches 29. Also, FIG. 3 shows that, during the displacement and deformation of the wedge 8 from the small volume configuration to the large volume configuration, a rear portion of the wedge 8 is brought from a position spaced from the inner surface of a top portion of the collar to a lesser-spaced position and then to an engaging position with the collar.

The movement of the plate 12, i.e., the movement of the manipulatable head of the fastening mechanism, drives, i.e., causes, movement of the wedge 8 and deformation of the wedge as it is brought selectively between the two positions shown in FIGS. 2 and 3. Further, it can be seen, with reference to FIG. 4 in conjunction with FIGS. 2 and 3, that as the plate 12, i.e., the manipulatable head of the fastening mechanism 11, is rotated between the small volume and large volume wedge positions of FIGS. 2 and 3, the axis A2 of the rivet 28—together with the portion of the wedge 8 to which the fastening mechanism 11 is fastened—rotates about axis A1. In so doing, the axis A2 of the rivet 28 and the wedge portion to which the fastening mechanism 11 is fastened move (albeit in an arc) between opposite sides of a vertical longitudinal plane (i.e., such as a plane parallel to the axis A1). As mentioned above, the distance "e" separating the axis A1 from the axis A2 determines the amplitude of the movement of the wedge with respect to the collar. This movement facilitates the deformation of the wedge, inasmuch as the wedge 8 is secured to the collar 3 via the first and second pivots (first pivot 6 being shown in FIGS. 2 and 3) during such movement.

As shown in FIG. 3, the deformation of the wedge 8 (i.e., from its shape shown in FIG. 2) results in the upper portion of the wedge 8 being displaced rearwardly with respect to its "small volume" position shown in FIG. 2.

In the position shown in FIG. 3, the rearward movement of the wedge 8 and the deformation of the wedge 8 are facilitated by the presence of the recess 25, or cutout, which is provided in the upper edge of the collar 3.

In addition, due to its deformation, the wedge is provided with a shape that better respects the user's morphology and ensures an adequate distribution of the forces exerted by the rear portion of the boot.

In another embodiment of the invention, not illustrated, sliding means are provided between the upper portion of the wedge 8 and the upper portion of the collar 3 so that the upper portion of the collar 3 deforms at the same time as the wedge 8.

Figure 6:
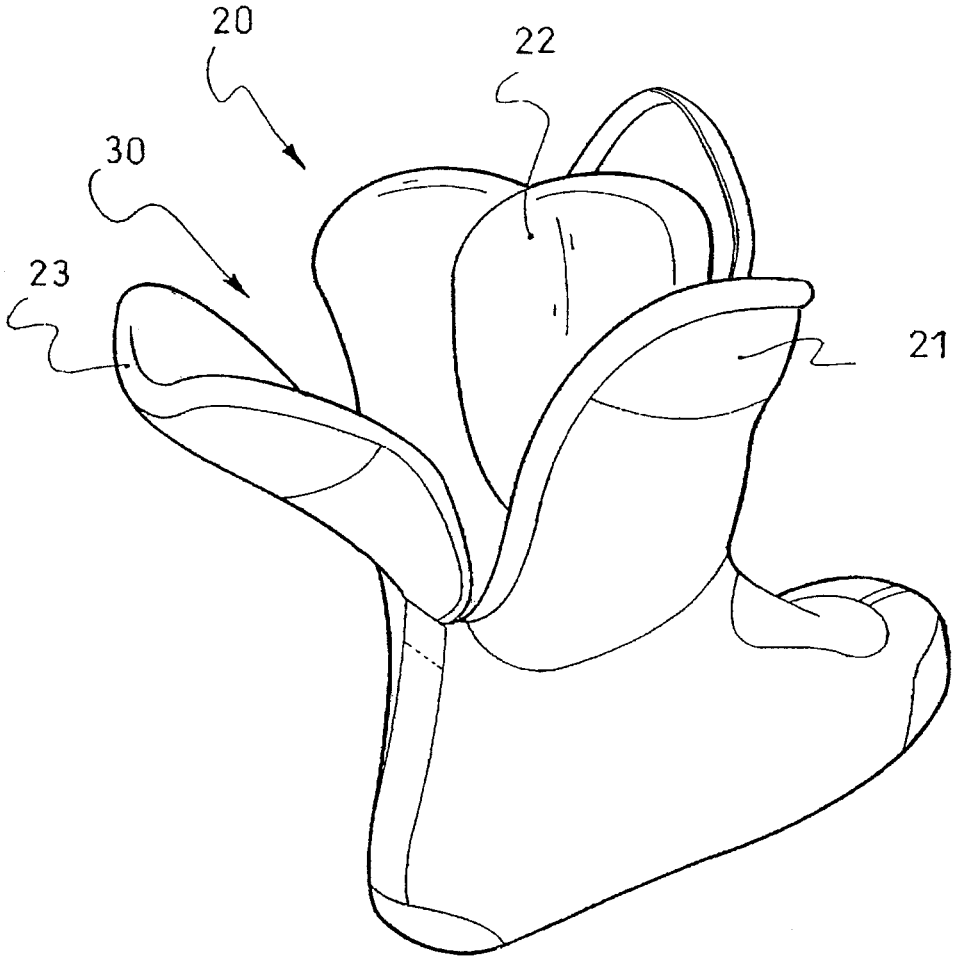
FIG. 6 is a rear perspective view of the liner.

FIG. 6 shows a comfort liner 20 having been removed from the outer upper. It is made by assembling various types of materials providing comfort for the user. In a known manner, a frontward opening is housed between two flaps 21. A front tongue 22 is positioned in this frontward opening.

A rear opening 30 is provided in the upper portion of the liner 20. A rear tongue 23 is positioned in the rear opening 30. The rear tongue 23 is connected to the liner 20 in the area of the lower portion of the rear opening. Thereby, the rear tongue 23 can tilt in a front-to-rear movement.

When the liner 20 is in place in the upper, the wedge 8 and the rear tongue 23 are in contact, so that the wedge 8, in its articulated movement about the first and second pivots, drives along the movement of the rear tongue 23. Such a movement of the rear tongue ensures a better adaptation of the liner 20 to the shape of the calf opposite the movement of the wedge 8.

The invention is not limited to the embodiment herein described by way of example and applies to any equivalent embodiment.

LIST OF ELEMENTS

1. boot
2. lower shell portion
3. collar
4. buckle
5. lower leg strap
6. first pivot
7. second pivot
8. wedge
9. first opening
10. second opening
11. fastening mechanism
12. plate

13. body
14. washer
15. abutment
16. sector
17. rim
18. indentation
19. boss
20. liner
21. flap
22. front tongue
23. rear tongue
24. third opening
25. recess
26. volume adjusting device
27. groove
28. rivet
29. notch
30. rear opening

The invention claimed is:

1. A sports boot comprising: an upper adapted to extend above an ankle joint of a wearer; said upper including a lower portion and at least one rigid collar; said collar being adapted to extend around a lower portion of a wearer's leg; a device for adjusting a volume of said collar to a shape of the wearer's calf; said device comprising a wedge positioned inside said collar; at least one pivot connecting said wedge to said collar, said pivot not connecting said collar to said lower portion of said upper when the sports boot is assembled; the at least one pivot extending above the ankle joint of the wearer; a fastening mechanism, spaced from said pivot along said collar, additionally connecting said wedge to said collar; said fastening mechanism comprising a manipulatable head rotatable about an axis extending through an interior of the boot, rotation of said manipulatable head of the fastening mechanism displacing said wedge within said collar and deforming said wedge; and a comfort liner positioned within the upper and in engagement with the wedge.

2. A sports boot according to claim 1, wherein:
said at least one pivot comprises a first pivot and a second pivot positioned on respective sides of said collar so that an axis of said first pivot and an axis of said second pivot are located on a first, substantially horizontal, plane;
said manipulatable head of the fastening mechanism does not extend in said first plane.

3. A sports boot according to claim 1, wherein:
said fastening mechanism is structured and arranged to cause said relative displacement of said wedge with respect to said collar;
said wedge includes at least one downwardly open notch enabling said deformation of said wedge during said displacement of said wedge.

4. A sports boot according to claim 1, wherein:
the comfort liner comprises a rear opening and a rear tongue.

5. A sports boot according to claim 1, wherein:
said one pivot extends along an axis;
said fastening mechanism connects said wedge to said collar below said axis of said pivot.

6. A sports boot according to claim 1, wherein:
said wedge extends upwardly beyond said collar.

7. A sports boot according to claim 1, wherein:
the wedge does not extend below the collar.

8. A sports boot according to claim 1, wherein:
said rotation of said manipulatable head of the fastening mechanism displaces the wedge along a surface of the collar.

9. A sports boot comprising:
an upper adapted to extend above an ankle joint of a wearer;
said upper including at least one rigid collar adapted to extend around a lower portion of a wearer's leg;
a device for adjusting a volume of said collar to a shape of the wearer's calf;
said device comprising a wedge positioned inside said collar;
at least one pivot connecting said wedge to said collar;
a fastening mechanism additionally connecting said wedge to said collar, said fastening mechanism designed to displace said wedge within said collar and to deform said wedge;
said fastening mechanism comprising:
a plate equipped with a body having an outer cylindrical surface extending around a central axis and received in a first circular opening provided in said collar; and
a rivet mounted for rotation during displacement of said wedge in a second circular opening provided in said wedge and received in a third circular opening extending around a central axis, the third circular opening being housed in the body of said plate, said axis of the third circular opening and said axis of the outer cylindrical surface of the body of said plate being parallel and non-coaxial.

10. A sports boot comprising: an upper comprising a lower portion and an upper portion, the upper portion designed to extend above an ankle joint of a wearer; the upper portion including a collar adapted to extend around a lower portion of a wearer's leg; a device for adjusting a volume of the collar to a shape of the wearer's calf; the device comprising a wedge positioned inside the collar; the wedge being mounted to the collar at three fastening points; a first and a second of the three fastening points consisting of a pair of laterally opposed pivots enabling the wedge to be pivotable forwardly and rearwardly selectively about the pair of pivots; the pivots extending above the ankle joint of the wearer and not connecting the collar to the lower portion of the upper when the sports boot is assembled; a fastening mechanism comprising a third of the three fastening points, the third fastening point mounting the wedge to the collar at a point vertically offset relative to each of the first and second connecting points; the fastening mechanism comprising a manipulatable head rotatable about an axis extending through an interior of the boot and being structured and arranged for movement selectively in at least either of two directions while the wedge is fastened to the collar by the fastening mechanism, said movement of the manipulatable head in a first of the two directions pivots the wedge forwardly about the pair of pivots with respect to the collar and said movement of the manipulatable head in a second of the two directions pivots the wedge rearwardly about the pair of pivots with respect to the collar; said movement of the wedge in the first and second directions deforming the wedge within the collar at an area corresponding to the wearer's calf.

11. A sports boot according to claim 10, wherein:
the fastening mechanism is structured and arranged to cause displacement of the third fastening point between the wedge and the collar during said movement in the first and second of the two directions.

12. A sports boot according to claim 10, wherein:
the pair of pivots extend along respective axes, said axes of the pair of pivots extending substantially within a plane;
the third fastening point extending below said plane.

13. A sports boot according to claim 10, wherein:
the wedge extends upwardly beyond the collar.

14. A sports boot according to claim 10, wherein:

said movement of the wedge in either of two directions includes movement of a portion the wedge with respect to the collar between opposite sides of a longitudinal vertical plane of the boot and between two different use positions of the boot.

15. A sports boot according to claim 10, wherein:

the wedge does not extend below the collar.

16. A sports boot comprising: a shell; a collar mounted on the shell, the collar being structured and arranged to extend above an ankle joint of a wearer and around a lower portion of the wearer's leg; a device for adjusting a volume of the collar to a shape of the wearer's calf; the device comprising a wedge positioned inside the collar, the wedge not extending below the collar; at least one pivot connecting the wedge to the collar, said at least one pivot extending above the ankle joint of the wearer; the pivot not connecting the collar to the shell when the sports boot is assembled; a fastening mechanism comprising a portion additionally connecting the wedge to the collar; the fastening mechanism comprising a manipulatable member accessible outside of the collar, the manipulatable member being structured and arranged, in response to manipulation of the manipulatable member, to move said portion of the fastening mechanism to deform the wedge, thereby adjusting the volume of the collar and defining two different use positions of the boot; movement of said portion of the fastening mechanism including movement of a portion the wedge with respect to the collar between opposite sides of a longitudinal vertical plane of the boot and between two different use positions of the boot.

17. A sports boot according to claim 16, further comprising:

two buckles positioned on the shell for closing the shell; and two buckles positioned on the collar for closing the collar.

18. A sports boot according to claim 17, further comprising:

a flexible lower leg strap positioned on the collar at an upper end of the boot.

19. A sports boot according to claim 1, wherein:

the fastening mechanism comprises a bushing extending within the collar;

the fastening mechanism comprises a body, the body positioned for rotation within the bushing.

20. A sports boot according to claim 10, wherein: the lower portion of the upper comprises a shell, the collar being connected to the shell; the pivots do not connect the collar to the shell of the upper.

21. A sports boot according to claim 10, wherein:

the fastening mechanism comprises a bushing extending within the collar;

the fastening mechanism comprises a body, the body positioned for rotation within the bushing.

22. A sports boot according to claim 16, wherein:

the fastening mechanism comprises a bushing extending within the collar;

the fastening mechanism comprises a body, the body positioned for rotation within the bushing.

23. A sports boot comprising: an upper comprising a lower portion and an upper portion, the upper portion designed to extend above an ankle joint of a wearer; said upper portion including a lower portion and at least one rigid collar; said collar being adapted to extend around a lower portion of a wearer's leg; a device for adjusting a volume of said collar to a shape of the wearer's calf; said device comprising a wedge positioned inside said collar; at least one pivot connecting said wedge to said collar, said pivot not connecting said collar to said lower portion of said upper; the at least one pivot extending above the ankle joint of the wearer and not connecting the collar to the lower portion of the upper when the sports boot is assembled; a fastening mechanism, spaced from said pivot along said collar, additionally connecting said wedge to said collar; said fastening mechanism being designed to displace said wedge within said collar and to deform said wedge as the wedge is displaced and deformed between a small volume configuration and a large volume configuration; during displacement and deformation of the wedge from the small volume configuration to the large volume configuration, a rear portion of the wedge is brought from a position spaced from an inner surface of a top portion of the collar to a lesser-spaced position from the inner surface of the top portion of the collar.

24. A sports boot according to claim 23, wherein:

the wedge does not extend below the collar.

25. A sports boot according to claim 23, wherein:

during the displacement and deformation of the wedge from the small volume configuration to the large volume configuration, the rear portion of the wedge is brought from a position spaced from an inner surface of a top portion of the collar to an engaging position from the inner surface of the top portion of the collar.

26. A sports boot comprising: an upper adapted to extend above an ankle joint of a wearer; the upper comprising at least one rigid collar adapted to extend around a lower portion of a wearer's leg when the leg is within an interior of the boot; a device for adjusting a volume of the collar to a shape of the wearer's calf; the device comprising a wedge positioned inside the collar; the wedge does not extend below the collar;

at least one pivot, extending along an axis, connecting at least a portion of the wedge for rotation about said axis within the collar, said axis of the pivot designed to be above the ankle joint of the wearer when the wearer's leg is within the interior of the boot, the collar not being pivoted; a fastening mechanism, spaced from the pivot along the collar, additionally connecting the wedge to the collar; the fastening mechanism comprising a body extending through a thickness of a wall of the collar and a fastener extending through a thickness of the wedge, the fastener engaging the wedge below the axis of the pivot; the body and the fastener of the fastening mechanism being designed to move the wedge within the collar while the wedge is connected to the collar, and to deform the wedge within the collar to adjust the volume of the collar between two positions of use of the boot.

* * * * *